US006379122B1

(12) United States Patent
Little

(10) Patent No.: US 6,379,122 B1
(45) Date of Patent: Apr. 30, 2002

(54) SYSTEM AND METHOD FOR AUTOMATIC THERMAL PROTECTION OF A FLUID COMPRESSING SYSTEM

(75) Inventor: Randal A. Little, Mocksville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/662,810

(22) Filed: Sep. 15, 2000

Related U.S. Application Data

(60) Provisional application No. 60/164,573, filed on Nov. 10, 1999.

(51) Int. Cl.[7] ..... F04B 49/00
(52) U.S. Cl. ..... 417/292
(58) Field of Search ..... 417/292, 282, 417/295, 302, 304

(56) References Cited

U.S. PATENT DOCUMENTS

| | | | | | |
|---|---|---|---|---|---|
| 3,602,610 | A | * | 8/1971 | Bloom | 417/12 |
| 3,873,239 | A | * | 3/1975 | Jamieson | 417/281 |
| 3,961,862 | A | * | 6/1976 | Edstrom et al. | 417/282 |
| 4,149,827 | A | * | 4/1979 | Hofmann, Jr. | 417/12 |
| 4,496,286 | A | * | 1/1985 | Gagnon | 123/275 |
| 4,863,355 | A | * | 9/1989 | Odagiri et al. | 417/12 |
| 5,362,207 | A | * | 11/1994 | Martin et al. | 165/140 |
| 5,820,352 | A | * | 10/1998 | Gunn et al. | 417/26 |
| 6,036,449 | A | * | 3/2000 | Nishar et al. | 471/292 |
| 6,077,052 | A | * | 6/2000 | Gunn et al. | 417/297 |
| 6,082,971 | A | * | 7/2000 | Gunn et al. | 417/32 |
| 6,174,137 | B1 | * | 1/2001 | Nakamura | 417/190 |

* cited by examiner

*Primary Examiner*—Teresa Walberg
*Assistant Examiner*—Vinod D Patel
(74) *Attorney, Agent, or Firm*—Michael Best & Friedrich LLP

(57) ABSTRACT

A method and apparatus for controlling a compressor system by sensing a temperature of compressed fluid in an outlet of a compressor and automatically reducing an output of the compressor when the temperature exceeds a predetermined temperature and a pressure in the outlet exceeds a predetermined pressure. High and low pressure settings may be provided so that the controller operates the compressor system at the appropriate setting based on the temperature of the compressed fluid in the compressor outlet. The output of the compressor may be controlled by limiting an amount of air permitted to enter the compressor's inlet and/or controlling the compressor's throttle. A three-way valve may also be provided to allow a user to chose between the high and low pressure settings.

20 Claims, 6 Drawing Sheets

SYSTEM AND METHOD FOR AUTOMATIC THERMAL PROTECTION OF A FLUID COMPRESSING SYSTEM

CROSS-REFERENCE TO RELATED APPLICATIONS

This application claims the benefit of and priority to U.S. Provisional Patent Application Serial No. 60/164,573, entitled "Automatic Thermal Valve Protection for a Dual Regulation System", filed Nov. 10, 1999.

BACKGROUND

The invention relates to an apparatus and method for controlling the pressure in a fluid compressing system, and more particularly to an apparatus and method for controlling the pressure in a dual pressure regulation fluid compressing system.

Conventional air compressors are designed to operate at a rated pressure such as, for example, 200 psig. Certain conventional compressors have pressure regulators that maintain air pressure in a fluid outlet or storage tank at the rated pressure. These compressors generally include sufficient power and cooling systems to allow the use of the compressor at the rated pressure under all loads and ambient temperature conditions without overheating the compressor.

However, certain compressed air powered machines benefit from air pressures higher than the rated pressure of the available air compressor. For example, certain drilling equipment is significantly more productive when supplied with compressed air in the range of 215–225 psig than when supplied with compressed air at the regulated 200 psig. In order to obtain a compressed air supply in the 215–225 psig range from a compressor rated at 200 psig, the user of the drilling equipment adjusts the regulator to regulate the compressor to 220 psig. The users' actions to adjust the regulator have led to compressor damage. Regulators and safety valves were damaged due to the excessive and repeated opening.

To accommodate the demand for a higher air pressure and to prevent damage to the compressor, a dual regulation system was developed. The dual regulation system employs two regulator valves (set at 200 and 220 psig for example) and a three-way valve to allow a user to select the pressure regulation setting.

While the dual regulation system eliminated the need for the user to tamper with the regulator, an additional problem developed. The compressor does not have sufficient cooling margin to provide the higher pressure at a high ambient temperature and/or a high load. Thus, sustained operation of the compressor at the higher setting (e.g. 220 psig) at a high ambient temperature or high load could cause compressor damage. Accordingly, there remains a need for a pressure regulation system that reduces the operating pressure automatically in response to high ambient temperature.

SUMMARY OF THE INVENTION

A system for controlling a compressor is provided. The compressor has a fluid outlet. A temperature sensor is positioned to sense a temperature of a compressed fluid in the fluid outlet. A first pressure regulator is provided for maintaining the pressure of the compressed fluid at a first predetermined pressure. A second pressure regulator is provided for maintaining the pressure of the compressed fluid at a second predetermined pressure, which is greater than the first predetermined pressure. A control system is provided for selecting either the first or second pressure regulator to maintain pressure of the compressed fluid. The control system is configured to select the first pressure regulator when the temperature sensor senses that the temperature of the compressed fluid exceeds a predetermined temperature. The control system may include a valve which is operated to select one of the pressure regulators. Each pressure regulator may be operatively connected to the fluid outlet of the compressor and has an open and closed condition, wherein the open condition reduces the pressure of the compressed fluid. The control system may further include an isolation valve that is operatively connected to the temperature sensor and opens to enable the first pressure regulator to control pressure of the compressed fluid. The control system also may include a three-way valve having a first and second position, wherein in the first position the first pressure regulator controls the pressure of the compressed fluid and in the second position the second pressure regulator controls the pressure of the compressed fluid.

In an alternative embodiment of the present invention, an apparatus for controlling a compressing system having dual pressure regulation is provided. The apparatus includes a control device having a fluid inlet and being operatively connected to the compressor for controlling a compressed fluid output of the compressor. A first fluid passage connects the compressor outlet to the fluid inlet of the control device. A low pressure regulator is positioned within the first fluid passage and has an open and closed condition. The low pressure regulator opens to permit compressed fluid to pass through the low pressure regulator when compressed fluid pressure in the compressor outlet exceeds a predetermined low pressure. A second fluid passage connects the compressor outlet to the inlet of the control device. A high pressure regulator is positioned within the second fluid passage and has an open and closed condition. The high pressure regulator opens to permit compressed fluid to pass through the high pressure regulator when compressed fluid pressure in the compressor outlet exceeds a predetermined high pressure. A shut-off valve is in series with the low pressure regulator and is controlled by the temperature sensor so that the shut-off valve opens when the temperature exceeds a predetermined maximum temperature, and closes when the temperature drops below a predetermined minimum temperature.

A third fluid passage may be provided to connect the outlet of the pressure regulator to the inlet of the control device. A three-way valve may be positioned between the second and third passages and the inlet of the control device. The three-way valve has a first position operatively connecting the third fluid passage to the control device, and a second position operatively connecting the second and third fluid passage s to the control device.

The control device may be an air cylinder for controlling a throttle of the compressor. The control device may also include an air cylinder for controlling a position of an air inlet valve to reduce an amount of fluid that enters the inlet of the compressor. The control device may also be a combination of the throttle controlling air cylinder and the inlet valve controlling air cylinder.

In yet another alternative, the present invention provides a fluid compressing system. The system includes a compressor and a controller that controls the compressor to reduce the pressure of the compressed fluid when the temperature of the compressed fluid reaches a predetermined temperature. The controller may be operatively connected to a throttle and/or inlet valve of the compressor. A pressure sensor may be positioned to sense the pressure of the compressed fluid in the outlet of the compressor. The controller controls the compressor to reduce the pressure of the compressed fluid when the temperature of the compressed fluid reaches a predetermined temperature and the pressure of the compressed fluid reaches a first predetermined pressure. The controller also controls the compressor to reduce the pressure of the compressed fluid when the pressure of the compressed fluid in the outlet reaches a second predetermined pressure.

The controller may be configured to have two states: a first state in which the controller controls the compressor so as to maintain a first pressure in the fluid outlet of the compressor, and a second state in which the controller controls the compressor so as to maintain a second pressure in the fluid outlet of the compressor. The controller operates in the first state when a temperature of the compressed fluid in the outlet exceeds a first predetermined temperature, and operates in the second state when the temperature falls below a second predetermined temperature.

A method for controlling a dual regulation fluid compressor system is also provided. The method includes the steps of: operating the compressor system at a high pressure setting so that an amount of compressed fluid produced by the compressor is reduced when pressure of the compressed fluid exceeds a predetermined high pressure; sensing a temperature of the compressed fluid; shifting the compressor system from the high pressure setting to a low pressure setting when the sensed temperature exceeds a first predetermined temperature; and operating the compressor system at the low pressure setting such that an amount of compressed fluid produced by the compressor is reduced when pressure of the compressed fluid exceeds predetermined low pressure. The method may include shifting the compressor system from the low pressure setting to the high pressure setting when the sensed temperature falls below a second predetermined temperature.

In an alternative embodiment, a method for controlling a dual regulation fluid compressor system is provided. The method includes the steps of: sensing a temperature of compressed fluid in an outlet of a compressor, reducing an output of the compressor when the temperature exceeds a first predetermined temperature and a pressure in the outlet exceeds a predetermined pressure. The method may further include the step of increasing the output when the temperature falls below a second predetermined temperature.

If is to be understood that both the foregoing general description and the following detailed description are exemplary and explanatory only and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Figure 1:
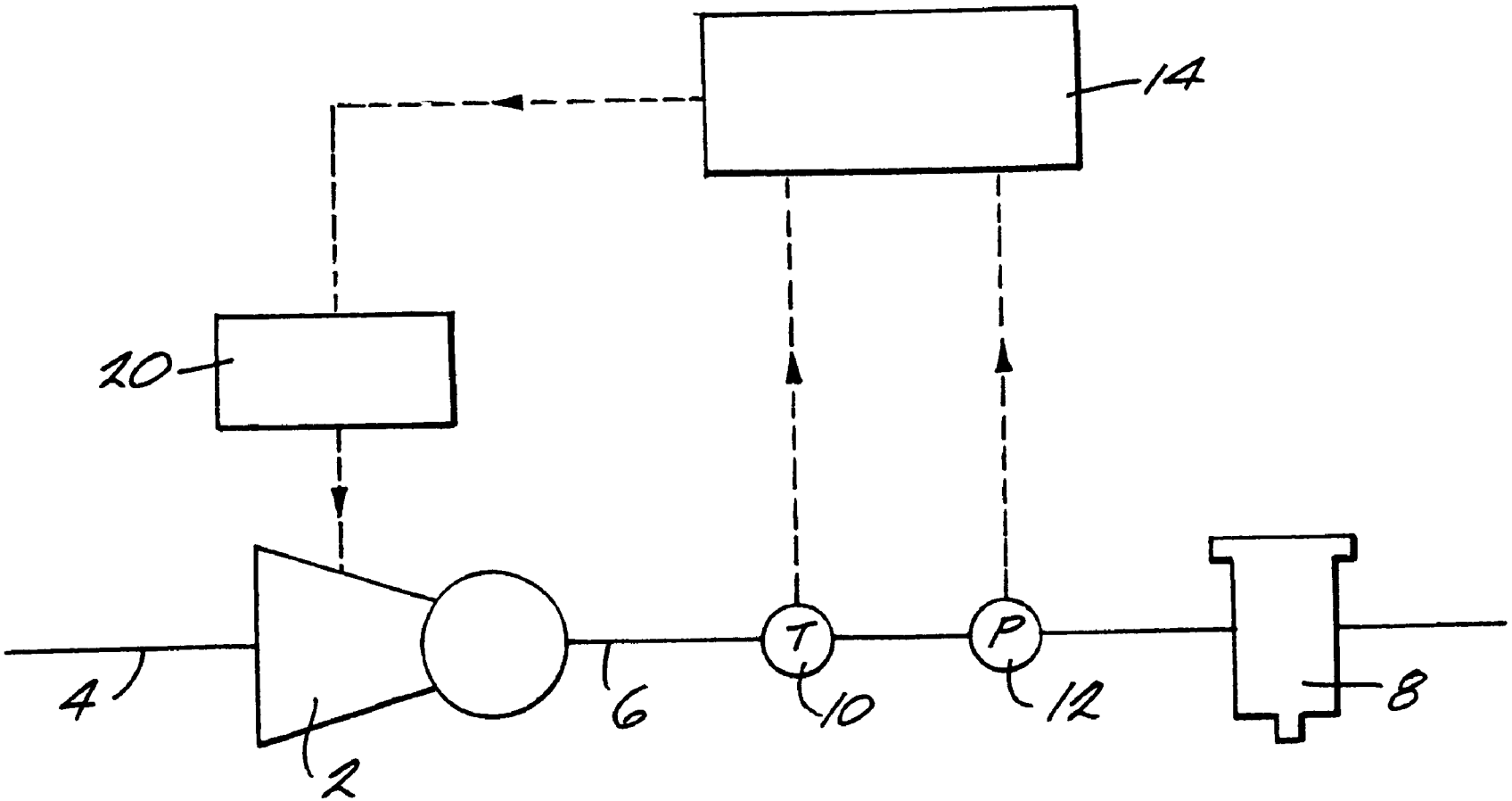
FIG. 1 is a schematic diagram of a pressure regulation system according to the present invention.

A pressure regulation system according to the present invention is shown in FIG. 1. The pressure regulation system works in conjunction with a fluid compressor 2. The compressor 2 provides compressed fluid, preferably air, to a receiver tank 8 and/or downstream loads, such as air motors.

An air inlet 4 is operatively connected to the compressor 2 to allow air into the compressor 2. The compressed air is delivered to an air outlet 6. From the air outlet 6, compressed air passes to the tank 8. A temperature sensor 10 and a pressure sensor 12 are positioned in the outlet 6 to sense the temperature and pressure, respectively, of the compressed air. A signal corresponding to the sensed temperature (T) and a sensed pressure signal corresponding to a sensed pressure (P) are provided to a controller 14. In response to the sensed temperature (T) and the sensed pressure (P), the controller 14 determines an appropriate control signal and relays that signal to a control device 20 that controls an amount of compressed air produced by the compressor 2 and provided into the air outlet 6. When the sensed temperature (T) exceeds a predetermined value ($T_H$), and the sensed pressure (P) exceeds a predetermined pressure ($P_L$) the controller 14 relays a signal to the control device 20 to reduce the amount of compressed air being produced by the compressor 2.

Figure 2:
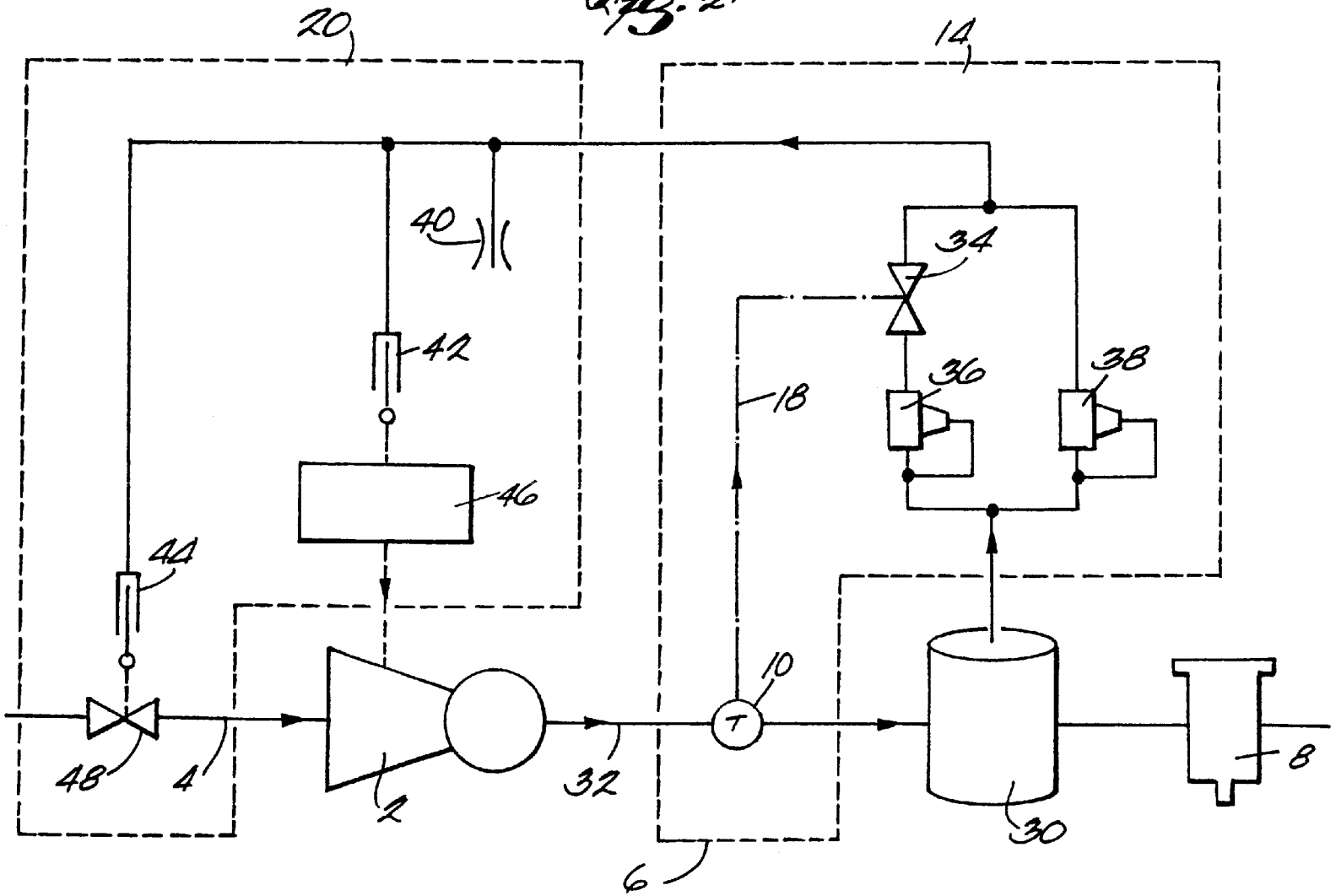
FIG. 2 is a schematic diagram of a first embodiment of the present invention.

As shown in FIG. 2, the air outlet 6 may include a separator tank 30 and a passage 32 connecting the compressor 2 to the separator tank 30. Compressed air produced by the compressor 2 passes through the passage 32 into the separator tank 30. The temperature sensor 10 is positioned in the passage 32 to sense the temperature of the compressed air.

The controller 14 may include a low pressure regulator 36 and a high pressure regulator 38. An upstream end of the low pressure regulator 36 is operatively connected to the separator tank 30. When air pressure in the separator tank 30 exceeds the low pressure limit ($P_L$) (e.g. 200 psig), the low pressure regulator 36 opens to lower pressure in the compressor outlet 6. A shut-off valve 34 is positioned in series with the low pressure regulator 36 and is controlled by the temperature sensor 10. An upstream end of the high pressure regulator 38 is operatively connected to the separator tank 30. When air pressure in the separator tank 30 exceeds the high pressure limit ($P_L$) (e.g. 220 psig), the high pressure regulator 38 opens to lower pressure in the compressor outlet 6. For convenience, the present invention is described with reference to a high pressure setting of 220 psig and a low pressure setting of 200 psig. However, the present invention is not so limited and may be employed with a variety of different pressure ranges.

The relationship between the temperature sensor 10 and the shut-off valve 34 is described with reference to FIG. 2. The temperature sensor 10 controls the shut-off valve 34 so that the valve 34 closes when the sensed temperature signal corresponding to a sensed temperature (T) exceeds a high temperature limit ($T_H$) and opens when the sensed temperature (T) falls below a low temperature limit ($T_L$). The temperature sensor 10 is operatively connected to the shut-off valve 34 by, for example, an electrical or mechanical linkage 18 as shown in FIG. 2. When the shut-off valve 34 is open, air pressure in the compressor outlet 6 is controlled by the low pressure regulator 36 because the low pressure regulator 36 will open and allow compressed air to pass downstream at a lower compressor outlet pressure than the high pressure regulator 38.

When the compressor system is operated at the high pressure setting, e.g., 220 psig, the cooling limiting ambient temperature of the system is compromised or reduced by about 10° F., which can place the cooling limit as low as 108° F. When the temperature of the compressed air exceeds 230° F., this cooling limit prevents continued operation of the compressor at the high pressure setting without damage. Thus, the compressor production must be lowered. Accordingly, the high temperature limit ($T_H$) is set at 230° F. However, when the compressed air temperature falls below 220° F., it again becomes safe to operate the system at the high pressure setting. Accordingly, the low temperature limit ($T_L$) is set at 220° F. While the low and high temperature limits are disclosed as 220° F. and 230° F., respectively, for this embodiment, it is within the scope of the invention to modify the temperature sensor 10 and the shut-off valve 34 so that other low and high temperature limits ($T_L$), ($T_H$) may be used. Additionally, the low and high temperature limits could also be set equal to each other.

The temperature sensor 10 may comprise a thermal switch, which closes at 230° F. and opens at 220° F. The shut-off valve 34 comprises a NC (normally closed) solenoid valve. Closing the thermal switch causes 24 VDC to be applied from a power source (not shown) to terminals of the NC solenoid valve through the linkage 18, causing it to open. When the sensed temperature (T) drops below 220° F., the thermal switch opens, causing the NC solenoid valve 34 to close.

The control device 20 may be described with reference to FIGS. 1 and 2. The downstream ends of the low pressure regulator 36 and the high pressure regulator 38 lead to an air inlet of the control device 20. The control device 20 may comprise a first air cylinder 42 for controlling a throttle 46 of the compressor 2, a second air cylinder 44 for controlling a position of an air inlet valve 48, and an air bleed orifice 40. When compressed air is supplied to the first air cylinder 42, the air cylinder 42 modifies the throttle position of the throttle 46 to reduce the amount of compressed air produced in the compressor 2. Similarly, when compressed air is supplied to the second air cylinder 44, the air cylinder 44 adjusts the position of the air inlet valve 48 to reduce an amount of air that enters the inlet 4 of the compressor 2. As a result, when compressed air is supplied to the control device 20 by the controller, the amount of compressed air produced by the compressor 2 is reduced, which, in turn, reduces the temperature of the compressor 2 thereby reducing the likelihood of damage.

While FIGS. 1 and 2 disclose the combined use of two air cylinders 42, 44 to control both the compressor's throttle and inlet air supply, the invention also includes a system in which only one of the two described control devices is employed. Furthermore, any other device known in the art for controlling an amount of compressed air produced by the compressor 2 may also be employed as a control device 20. Reference to control device 20 should be understood to include any of the above-described combinations.

Figure 3:
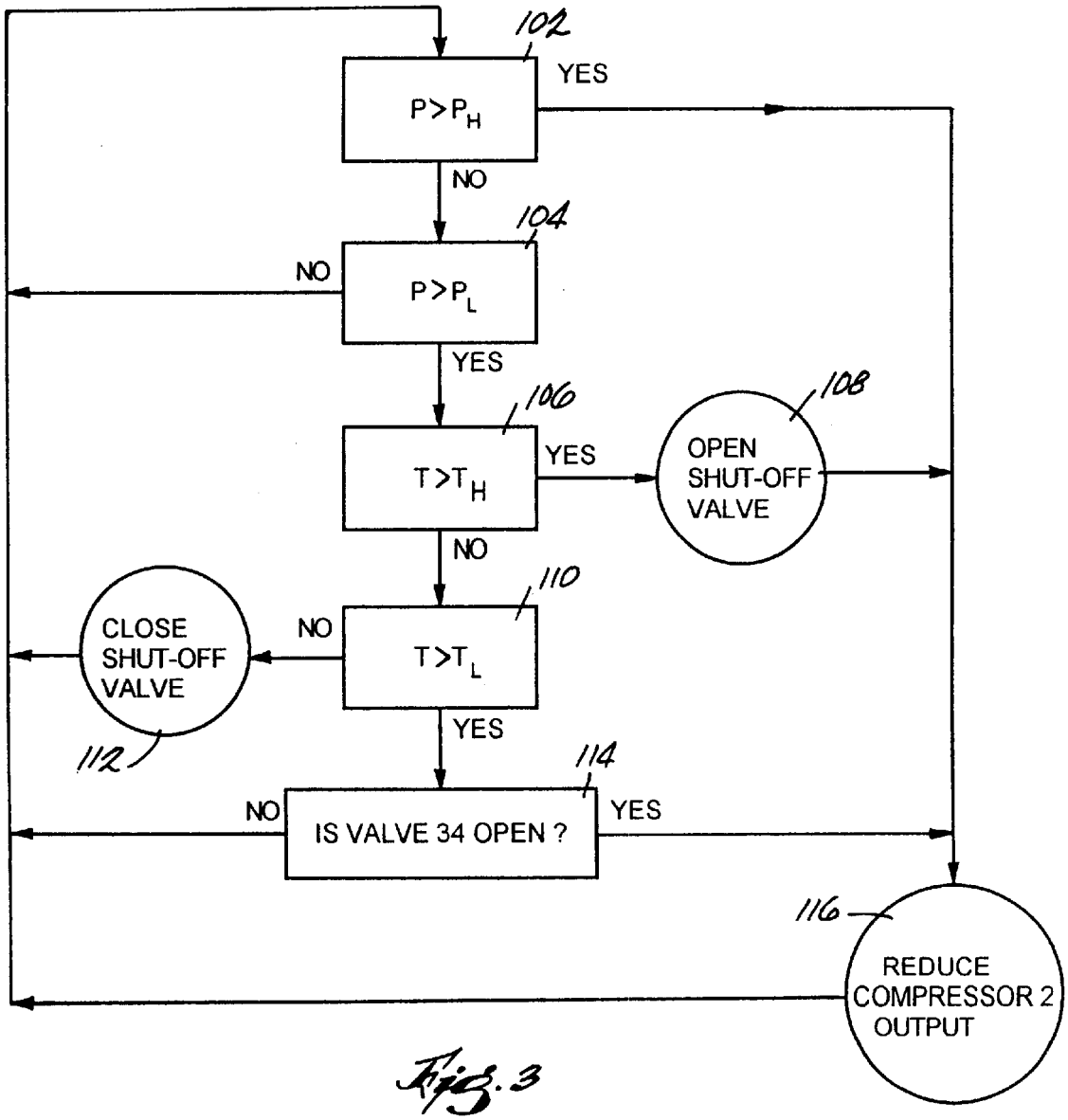
FIG. 3 is a logic flowchart of the controller of the first embodiment of the present invention.

Hereinafter, the operation of the invention will be described with reference to FIG. 3, which illustrates a flowchart of the logic of controller 14. Initially, at step 102, a determination is made whether the sensed pressure (P) exceeds the high pressure limit ($P_H$). If YES, the compressor output is reduced at step 116. If NO, a determination is made whether the sensed pressure (P) exceeds the low pressure limit ($P_L$) at step 104. If NO, the flowchart returns to step 102. If YES, a determination is made whether the sensed temperature (T) exceeds the high temperature limit ($T_H$) at step 106. If YES, the shut-off valve 34 is opened at step 108, the compressor output is reduced at step 116, and the flowchart returns to step 102. If NO, a determination is made whether the sensed temperature (T) exceeds the low temperature limit ($T_L$) at step 110. If NO, the shut-off valve 34 is closed and the flowchart returns to step 102. If YES, a determination is made at step 114 if the shut-off valve 34 is open. If YES, the compressor output is reduced at step 116 and the flowchart returns to step 102. If NO, the flowchart returns to step 102.

The logic described above allows the controller 14 to operate so that the air pressure in the outlet of the compressor 2 is maintained at the high pressure limit unless the sensed temperature is too high, the sensed pressure is too high, or a combination of both. As can be seen from the flowchart in FIG. 3, the controller 14 may comprise a microprocessor that receives inputs from the various sensors and outputs controlling signals to the various regulators and valves.

Figure 4:
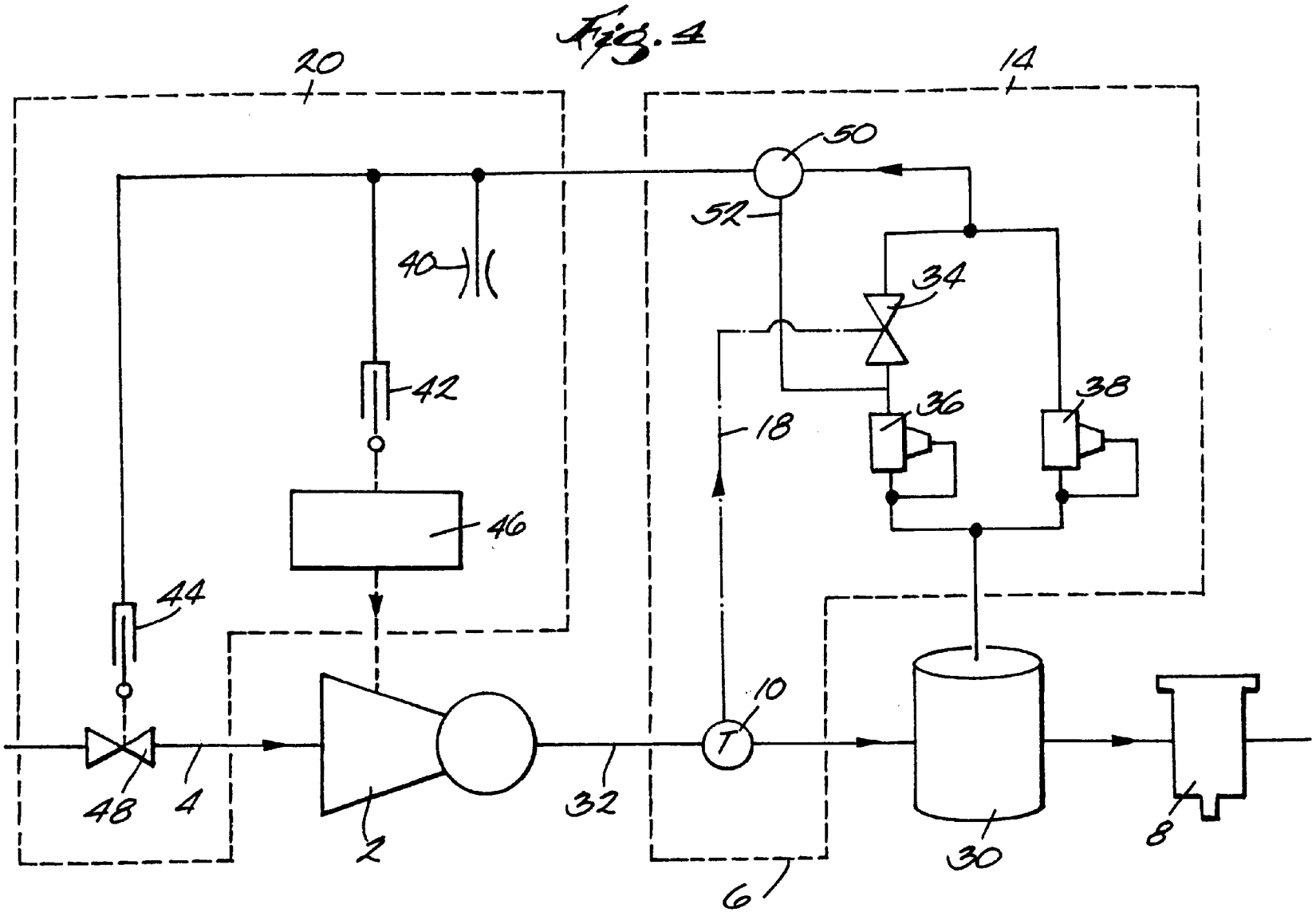
FIG. 4 is a schematic diagram of a second embodiment of the present invention.

FIG. 4 illustrates an alternative embodiment of the present invention. As shown in FIG. 4, the system may include a bypass passage 52 and a three-way valve 50. The bypass passage 52 permits direct operative connection between the downstream end of the low pressure regulator 36 and the three-way valve 50. Thus, the bypass passage 52 operatively connects the low pressure regulator 36 to the control device 20 and avoids the shut-off valve 34.

The three-way valve 52 allows a user to select between a low pressure setting and a high pressure setting such that the compressed air pressure may be selectively maintained at either the high or low pressure setting. The three-way valve 52 has user-selected positions. A first position, which represents the low pressure position, operatively connects the downstream end of the low pressure regulator 36 to the control device 20. A second position, which represents the high pressure setting, operatively connects the downstream end of the high pressure regulator 38 and the downstream end of the shut-off valve 34 with the control device 20.

When the second position (high pressure setting) of the three-way valve 52 is selected, the controller 14 operates in the same manner as in the first embodiment described above and shown in FIG. 3. When the first position (low pressure setting) of the three-way valve is selected, controller 14 simply reduces the amount of compressed air produced by the compressor 2 when the sensed pressure (P) exceeds the low pressure limit ($P_L$). Mechanically, this may be accomplished by opening the low pressure regulator when the upstream pressure exceeds the low pressure limit ($P_L$). Compressed gas therefore passes through the low pressure regulator 36 and three-way valve 50 to the control device 20.

It should be noted that when the first position of the three-way valve 50 (low pressure setting) is selected, the opening and closing of the shut-off valve 34 has no effect on the functioning of the compressor system.

The three-way valve 50 is positioned downstream from the pressure regulators 36, 38. However, it is also possible to position the three-way valve upstream from the pressure regulators 36, 38. Positioning the three-way valve 50 downstream from the pressure regulators 36, 38 reduces the pressures seen by the three-way valve 50. As a result, the valve operates more easily and the seals in the valve 50 will last longer.

Figure 5:
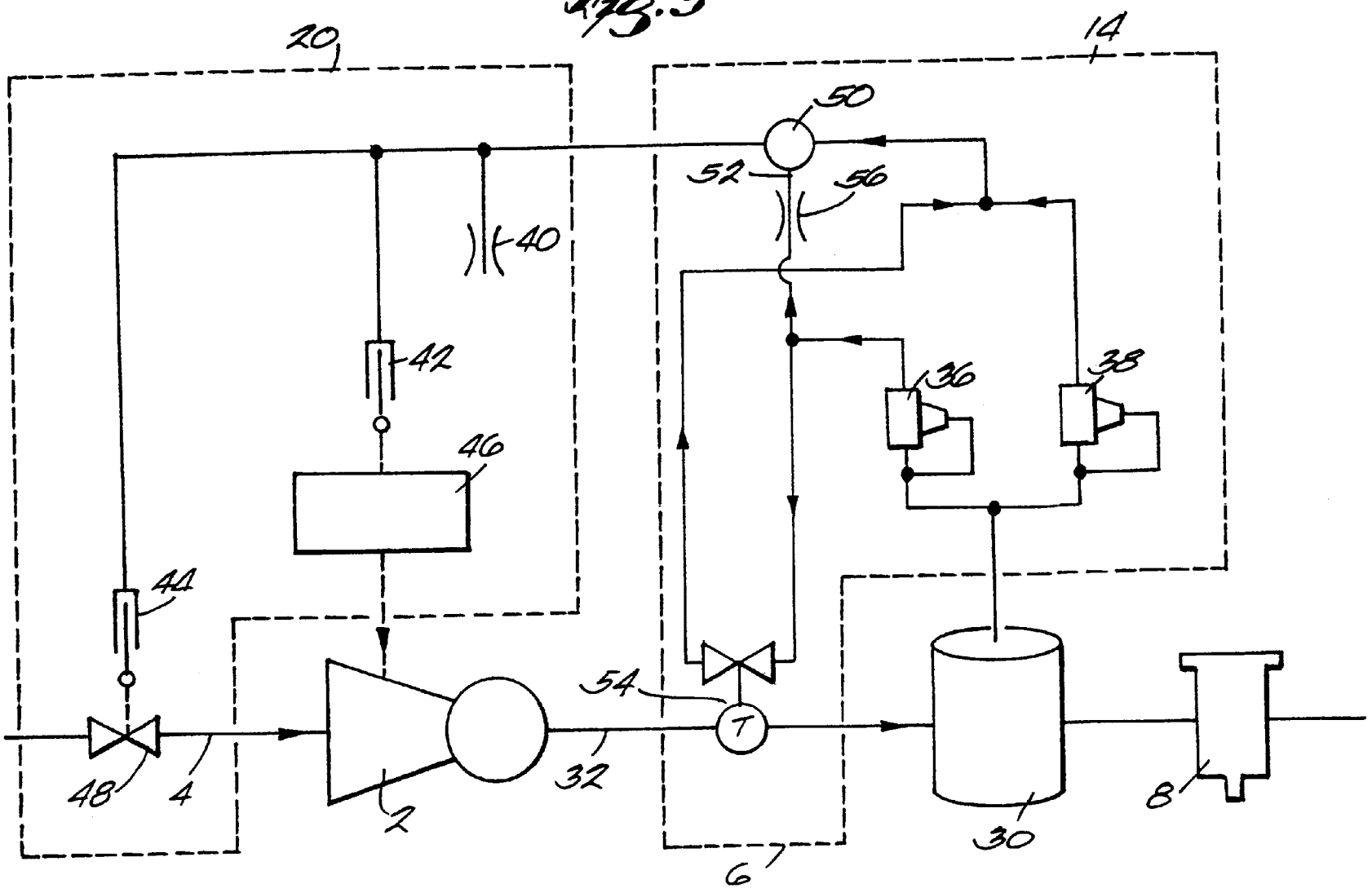
FIG. 5 is a schematic diagram of a third embodiment of the present invention.

FIG. 5 illustrates another embodiment of the present invention, which is similar to the embodiments described above except that temperature sensor 10 and the shut-off valve 34 comprise a NC thermostatic type valve 54. The thermostatic valve 54 opens when its sensing bulb senses a temperature of 230° F. and closes if its sensing bulb senses a temperature of less than 230° F. This embodiment has an advantage over the first and second embodiments in that no electrical interface is required.

In this embodiment, an orifice 56 is provided in the bypass passage 52. The orifice 56 is sized to equal the restriction of the thermostatic valve, which is generally restrictive in the applicable size range. The orifice 56 allows the regulated pressure and range of the compressor system to be the same whether the path is through the low pressure regulator 36 and the orifice 56 in series, or through the low pressure regulator 36 and the thermostatic valve 54 in series.

Figure 6:
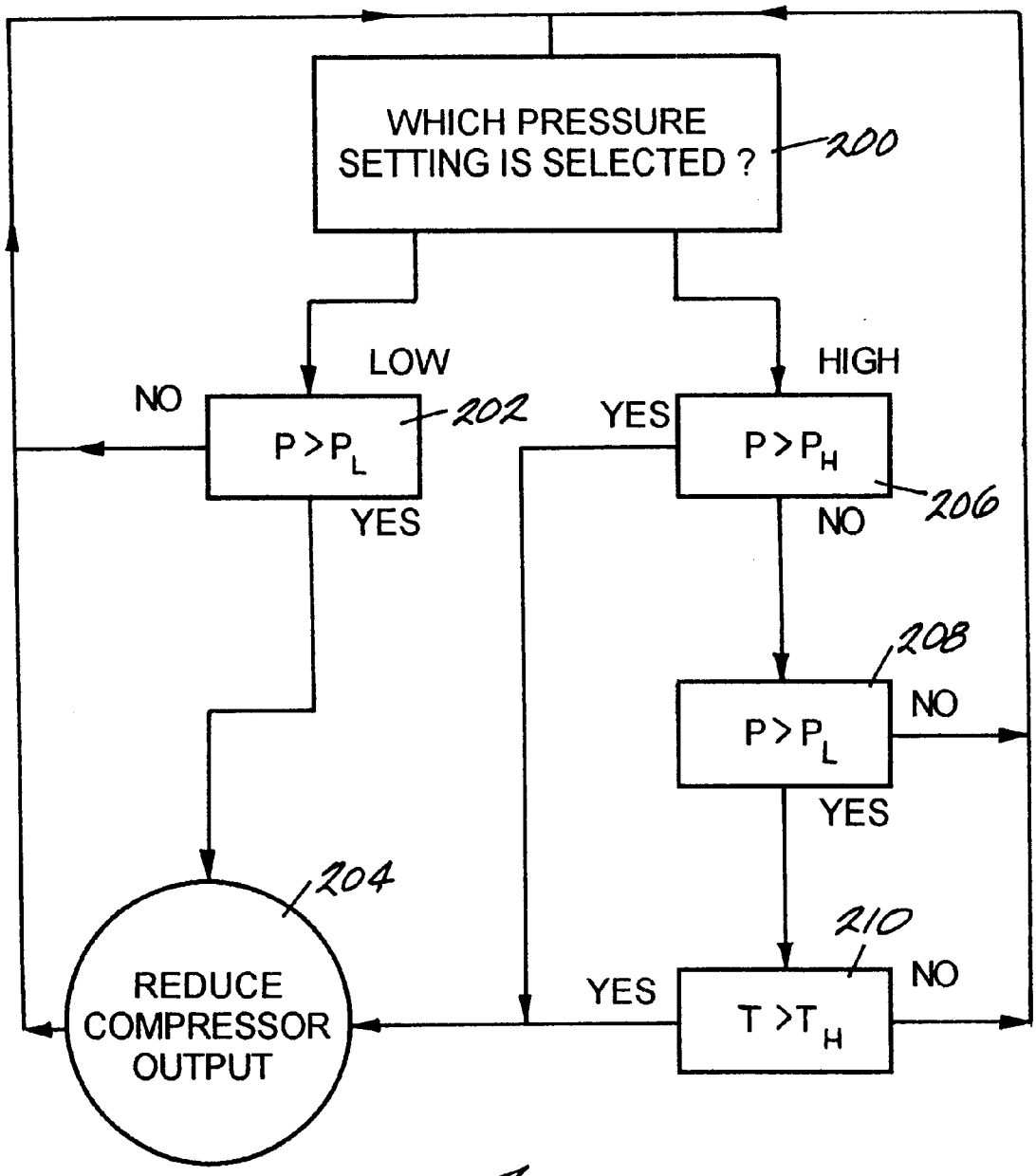
FIG. 6 is a logic flowchart of the controller of the third embodiment of the present invention.

FIG. 6 shows the logic flowchart for the system of FIG. 5. Because the thermostatic valve has equivalent high and low temperature limits, i.e. 230° F. as the temperature limit, as opposed to the distinct high and low temperature limits of the earlier described embodiments, i.e. 230° F. and 220° F., respectively, the logical flowchart of the third embodiment's controller is slightly different than that shown in FIG. 3. Initially, at step 200, a determination is made of which pressure setting is selected. If the LOW pressure setting is selected, a determination is made at step 202 whether the sensed pressure (P) exceeds the low pressure limit ($P_L$). If NO, the flowchart returns to step 200. If YES, the compressor output is reduced at step 204 and the flowchart returns at step 200.

If the HIGH pressure setting is selected at step 200, a determination is made at step 206 if the sensed pressure (P) exceeds the high pressure limit ($P_H$). If YES, the compressor output is reduced at step 204 and the flowchart returns to step 200. If NO, a determination is made at step 208 whether the sensed pressure (P) exceeds the low pressure limit ($P_L$). If NO, the flowchart returns to step 200. If YES, a determination is made at step 210 whether the sensed temperature (T) exceeds the temperature limit ($T_H$). If NO, the flowchart returns to step 200. If YES, the compressor output is reduced at step 204 and the flowchart returns to step 200.

The load on the compressor 2 may comprise any type of device that requires a supply of compressed air. The compressor 2 may comprise any type of air/fluid compressor known in the art (e.g. rotary screw, centrifugal, reciprocating, etc.). It should also be noted that while the working fluid is described as air, the invention could be used with any other compressible fluid.

The priority document, provisional application Serial No. 60/164,373, filed Nov. 10, 1999, including its specification and drawings, is hereby incorporated by reference into this application.

The above described embodiments are illustrative only. Other variations of the present invention will fall within the scope of this invention, the scope of which is only to be limited by the language of the following claims.

What is claimed is:

1. A system for controlling a compressor comprising:

a compressor having a fluid outlet;

a temperature sensor positioned to sense a temperature of a compressed fluid in the fluid outlet;

a first pressure regulator for maintaining the pressure of the compressed fluid at a first predetermined pressure;

a second pressure regulator for maintaining the pressure of the compressed fluid at a second predetermined pressure, wherein the second predetermined pressure is greater than the first predetermined pressure;

a control system for selecting either the first or second pressure regulator to maintain pressure of the compressed fluid, wherein the control system is configured to select the first pressure regulator when the temperature sensor senses that the temperature of the compressed fluid exceeds a predetermined temperature.

2. The system of claim 1, wherein the control system includes a valve which is operated to select one of the pressure regulators.

3. The system of claim 1, wherein each pressure regulator is operatively connected to the fluid outlet of the compressor.

4. The system of claim 3, wherein each pressure regulator has an open and closed condition, the regulator being in the open condition to reduce the pressure of the compressed fluid.

5. The system of claim 4, wherein the control system includes an isolation valve that opens to enable the first pressure regulator to control pressure of the compressed fluid.

6. The system of claim 5, wherein the isolation valve is operatively connected to the temperature sensor.

7. The system of claim 4, wherein the control system includes a three-way valve having a first and second position, wherein in the first position the first pressure regulator is enabled to control the pressure of the compressed fluid and in the second position the second pressure regulator is enabled to control the pressure of the compressed fluid.

8. An apparatus for controlling a compressor system employing dual pressure regulation comprising:

a compressor having a fluid inlet and outlet;

a temperature sensor positioned to sense a temperature in the compressor outlet;

a control device having a fluid inlet and being operatively connected to the compressor for controlling a compressed fluid output of the compressor;

a first fluid passage connecting the compressor outlet to the fluid inlet of the control device;

a low pressure regulator positioned within the first fluid passage and having an open and closed condition, said low pressure regulator opening to permit compressed fluid to pass through the low pressure regulator when compressed fluid pressure in the compressor outlet exceeds a predetermined low pressure;

a second fluid passage connecting the compressor outlet to the inlet of the control device;

a high pressure regulator positioned within the second fluid passage and having an open and closed condition, said high pressure regulator opening to permit compressed fluid to pass through the high pressure regulator when compressed fluid pressure in the compressor outlet exceeds a predetermined high pressure; and a shut-off valve in series with the low pressure regulator and controlled by the temperature sensor so that the shut-off valve opens when the temperature exceeds a predetermined maximum temperature, and closes when the temperature drops below a predetermined minimum temperature.

9. The apparatus according to claim 8, further comprising a third fluid passage connecting the outlet of the pressure regulator to the inlet of the control device.

10. The apparatus according to claim 9, further comprising a three-way valve positioned between the second and third passages and the inlet of the control device, said three-way valve having a first position operatively connecting the third fluid passage to the control device, and a second position operatively connecting the second fluid passage to the control device.

11. The apparatus according to claim 10, wherein the second position of the three-way valve operatively connects the first fluid passage to the control device.

12. The apparatus as claimed in claim 8, wherein the control device comprises an air cylinder for controlling a throttle of the compressor.

13. The apparatus as claimed in claim 8, wherein the control device comprises an air cylinder for controlling a position of an air inlet valve to reduce an amount of fluid that enters the inlet of the compressor.

14. The apparatus as claimed in claim 13, wherein the control device further comprises a second air cylinder for controlling a throttle of the compressor when compressed fluid is supplied to the inlet of the additional air cylinder.

15. A fluid compressing system comprising:

a compressor having a fluid inlet and a fluid outlet, the outlet configured to receive compressed fluid; and a controller including a temperature sensor positioned to sense a temperature of the compressed fluid in the outlet, the controller controlling the compressor to reduce a pressure of the compressed fluid in the outlet when the temperature of the compressed fluid in the outlet reaches a predetermined temperature such that the pressure of the compressed fluid in the outlet of the compressor is generally maintained at a predetermined pressure and the predetermined pressure is reduced when the compressed fluid temperature in the outlet exceeds the predetermined temperature.

16. The fluid compressing system according to claim 15 wherein the controller is operatively connected to a throttle of the compressor.

17. The fluid compressing system according to claim 15, wherein the controller is operatively connected to a fluid inlet valve for limiting an amount of fluid that enters the fluid inlet of the compressor.

18. The fluid compressing system according to claim 15, wherein the controller further comprises a pressure sensor positioned to sense the pressure of the compressed fluid in the outlet of the compressor, wherein the controller controls the compressor to reduce the pressure of the compressed fluid in the outlet when the temperature of the compressed fluid in the outlet reaches a predetermined temperature and the pressure of the compressed fluid in the outlet reaches a first predetermined pressure.

19. The fluid compressing system according to claim 18, wherein the controller controls the compressor to reduce the pressure of the compressed fluid in the outlet when the pressure of the compressed fluid in the outlet reaches a second predetermined pressure.

20. The fluid compressing system according to claim 15, wherein the controller has two states:

a first state in which the controller controls the compressor so as to maintain a first predetermined fluid pressure in the fluid outlet of the compressor, and a second state in which the controller controls the compressor so as to maintain a second predetermined fluid pressure in the fluid outlet of the compressor, wherein the controller operates in the first state when a temperature of the compressed fluid in the outlet exceeds a first predetermined temperature, and operates in the second state when the temperature falls below a second predetermined temperature.

* * * * *